US007369097B1

(12) United States Patent
Sherwood

(10) Patent No.: US 7,369,097 B1
(45) Date of Patent: May 6, 2008

(54) COLLAPSIBLE TRIPOD MOUNT FOR A DISH ANTENNA ASSEMBLY

(75) Inventor: William J. Sherwood, West Burlington, IA (US)

(73) Assignee: Winegard Company, Burlington, IA (US)

( * ) Notice: Subject to any disclaimer, the term of this patent is extended or adjusted under 35 U.S.C. 154(b) by 0 days.

(21) Appl. No.: 11/670,871

(22) Filed: Feb. 2, 2007

(51) Int. Cl.
*H01Q 1/08* (2006.01)

(52) U.S. Cl. ..... 343/880; 343/757; 343/765; 343/882

(58) Field of Classification Search ..... 343/757, 343/765, 880, 881, 882, 878
See application file for complete search history.

(56) References Cited

U.S. PATENT DOCUMENTS 4,204,214 A * 5/1980 Fassnacht ..... 343/766
4,644,365 A * 2/1987 Horning ..... 343/882
4,814,781 A * 3/1989 DeHaven ..... 343/766
5,363,116 A * 11/1994 Allen ..... 343/881
6,630,912 B2 * 10/2003 Ehrenberg et al. ..... 343/882

* cited by examiner

*Primary Examiner*—Tho Phan
(74) *Attorney, Agent, or Firm*—W. Scott Carson

(57) ABSTRACT

A collapsible tripod mount for a portable dish antenna assembly. The assembly includes a dish member and a post member extending downwardly from it. The tripod includes three legs selectively lockable in an open position to support the dish antenna assembly and a collapsed or closed position with the dish antenna assembly removed. The locking arrangement for both the open and collapsed positions of the tripod includes a plate with first and second sets of holes. Each set of holes selectively receives end portions of the tripod legs. The tripod further includes an adjustable azimuth arrangement mounted on one tripod leg and supporting the post and dish members thereon.

33 Claims, 14 Drawing Sheets

COLLAPSIBLE TRIPOD MOUNT FOR A DISH ANTENNA ASSEMBLY

BACKGROUND OF THE INVENTION

1. Field of the Invention

This invention relates to the field of tripod mounts and more particularly to the field of such mounts for dish antenna assemblies.

2. Discussion of the Background

Dish antenna assemblies are commonly mounted to platforms such as homes or recreational vehicles. In these mounts, the dish of the antenna assembly can be relatively easily and quickly aligned with the transmitting and/or receiving satellite and rigidly held in place. The home or vehicle in these arrangements provides a very stable and substantially permanent is structure to support the antenna. In contrast, dish antenna systems that are portable and intended to be mounted simply on collapsible tripods such as at campsites or in backyards offer significant design problems. In particular, the tripod mount must be very stable and strong to support the antenna (e.g., 40 pounds) in proper alignment yet easily and quickly collapsible into a compact shape for storage and transport.

With these and other problems in mind, the present invention was developed. In it, a tripod mount is provided that can be set up and collapsed fairly quickly and easily. Additionally, the tripod is provided with an adjustable azimuth arrangement mounted on one leg of the tripod. The dish antenna can then be supported on the tripod leg and its azimuth orientation conveniently adjusted as desired. The present invention is particularly adaptable for two-way communications where it is desirable to be able to set up virtually anywhere.

SUMMARY OF THE INVENTION

This invention involves a collapsible tripod mount for a portable dish antenna assembly. The assembly includes a dish member and a post member extending downwardly from it. The tripod in turn includes three legs selectively lockable in an open position to support the dish antenna assembly and a collapsed or closed position with the dish antenna assembly removed. In the collapsed position, the tripod legs are closely adjacent one another and securely locked in place for storage or transport.

The locking arrangement for both the open and collapsed positions of the tripod includes a plate with first and second sets of holes. Each set of holes selectively receives end portions of the tripod legs. The holes of the first set are spaced about a vertical axis and receive the end portions of the tripod legs with the tripod in its open position. Similarly, the second set of holes receives the end portions when the tripod is in its collapsed or closed position. The locking plate in this regard is pivotally mounted to one of the tripod legs for movement about a horizontal axis. In operation, the plate can be pivoted upwardly to lift the holes away from receiving the end portions of the legs. Thereafter, the legs can be moved as desired between the open and closed positions and the plate again pivoted downwardly to receive the leg end portions in the desired set of holes to lock the legs securing in place.

The post member extending downwardly from the dish member of the dish antenna assembly is supported on one leg of the tripod, which leg includes an adjustable azimuth arrangement. In use, the azimuth arrangement with the post member of the dish antenna assembly supported on it can be adjusted as desired about a vertical axis to properly orient the dish member of the assembly. The adjustable azimuth arrangement has a truncated conical member with a horizontal slot. The post member is preferably cylindrical with a lower open end that has a pin extending across it. In use, the cylindrical open end can be placed over the truncated conical member at an inclined angle with the pin at least partially received in the slot and most of the weight of the dish antenna assembly supported on the tripod. The post member with the dish member attached to it can then be easily moved or rocked to align the post member vertically on the conical member with the pin fully received in the slot.

In doing so, the post member strikes and closes two clamp arms mounted on the locking plate. After adjusting the azimuth orientation of the conical member and post and dish members supported on it, the clamp arms can be tightened to securely hold the post member and attached dish member in place. In aligning the dish member for the strongest receiving and/or transmitting signal, the dish member extends away from the post member toward the vertical axis of the tripod 1. The bulk of the weight (e.g., 40 pounds) of the dish antenna assembly is then positioned substantially centrally over the tripod for a strong and stable mount.

DETAILED DESCRIPTION OF THE INVENTION

Figure 1:
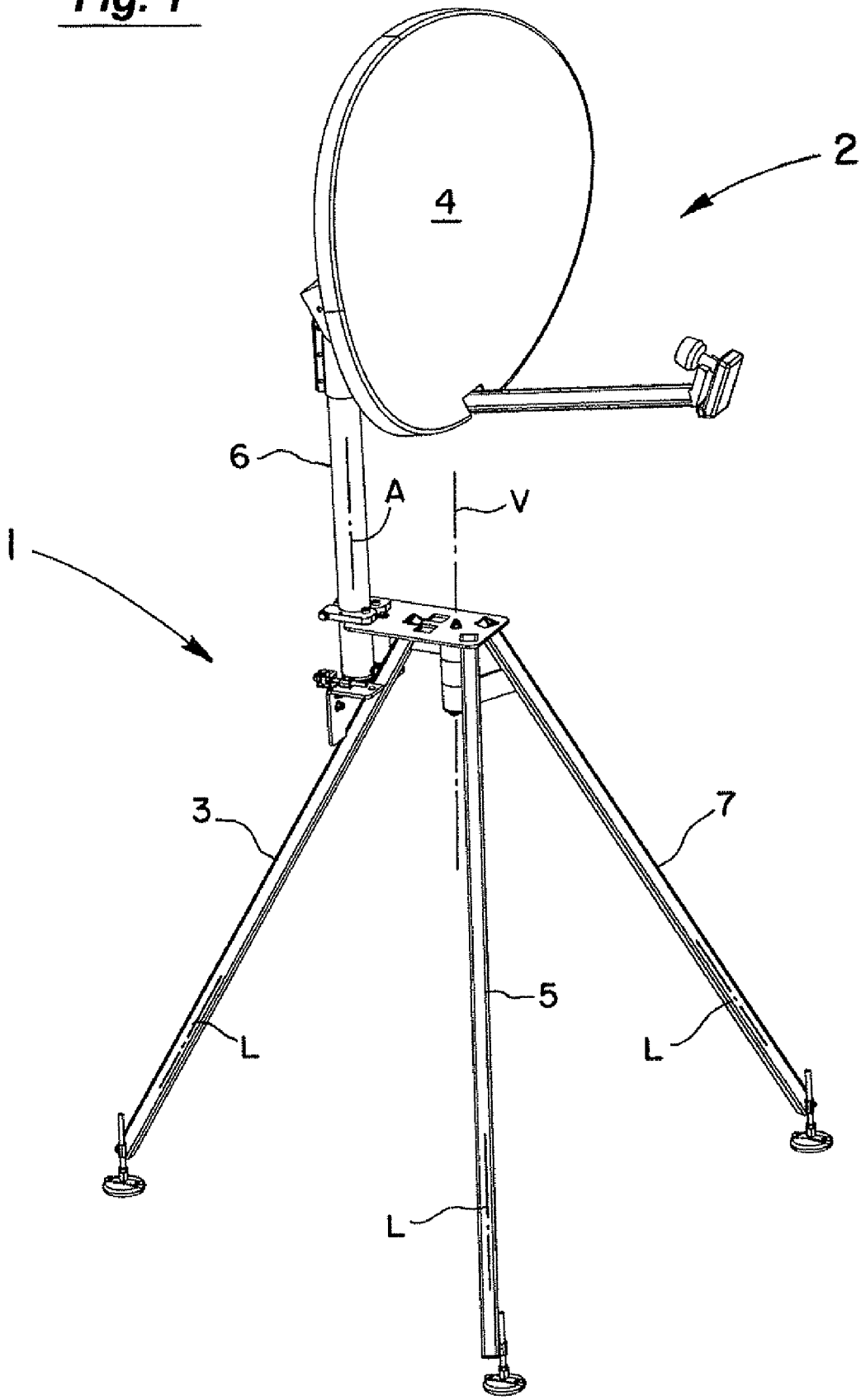
FIG. 1 is a perspective view of the tripod of the present invention with the dish antenna assembly supported on it.
Figure 2:
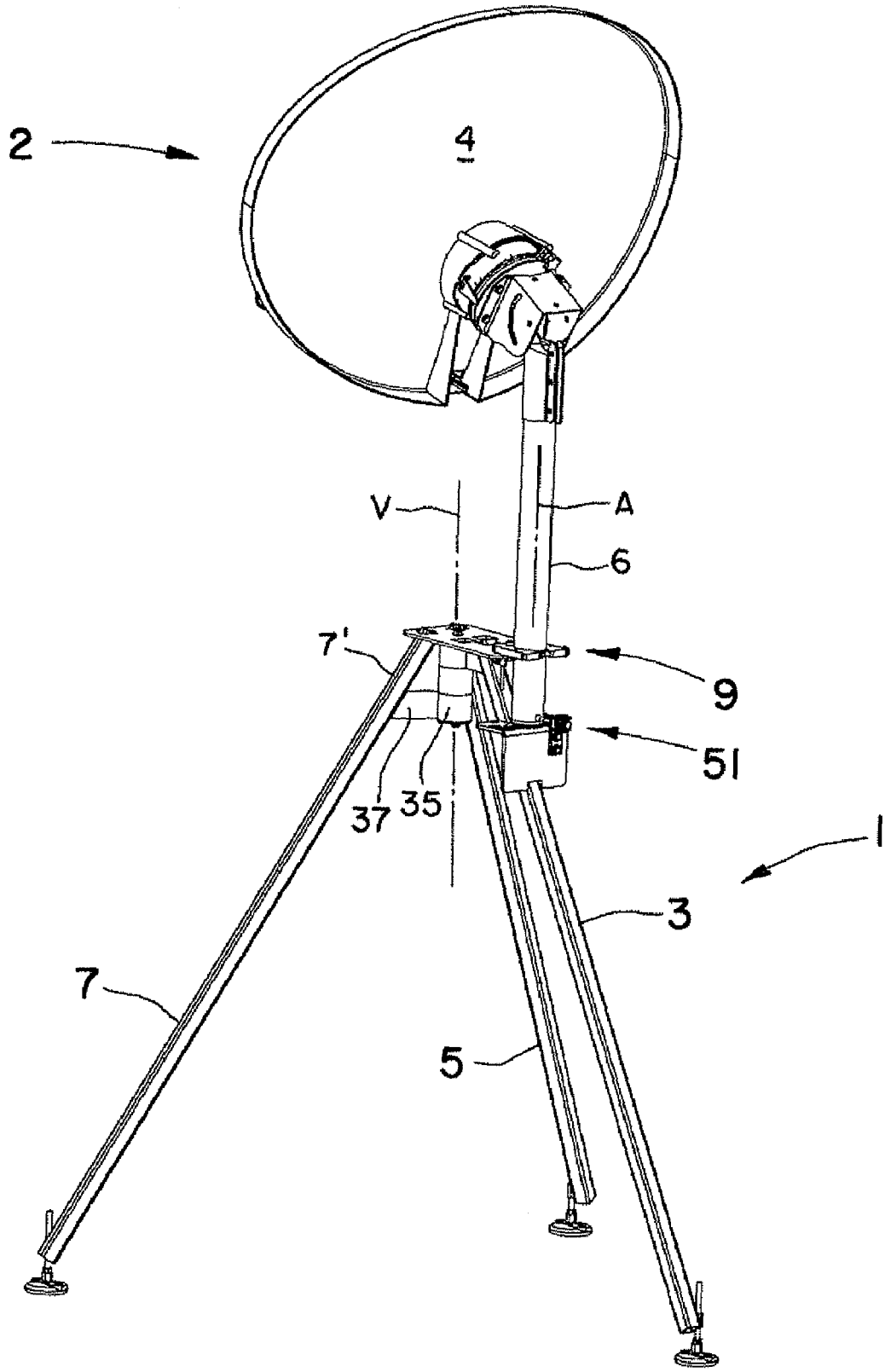
FIG. 2 is a rear perspective view of FIG. 1.
Figure 3:
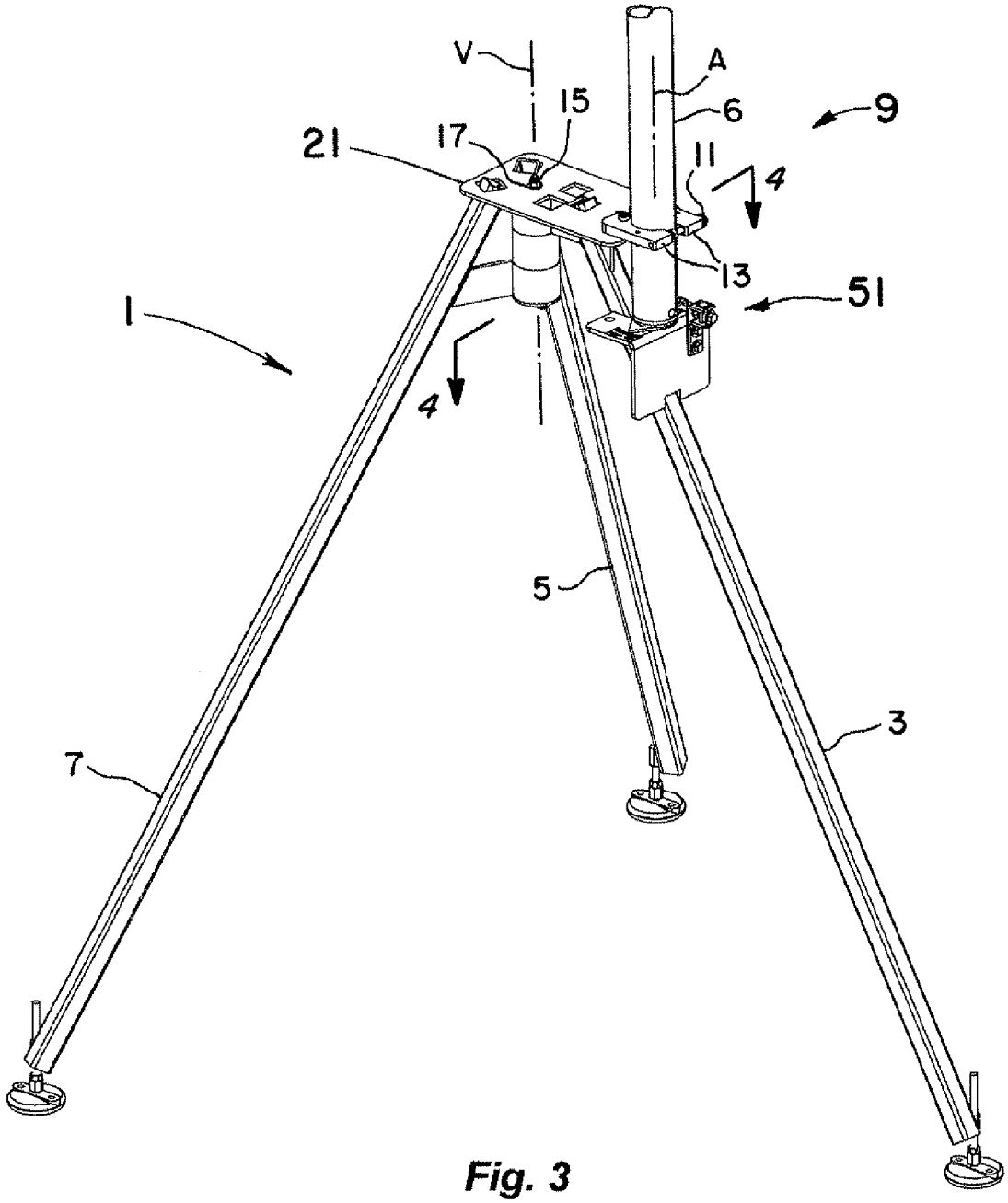
FIG. 3 is an enlarged view of the tripod and post member of the dish antenna assembly supported on it.
Figure 4:
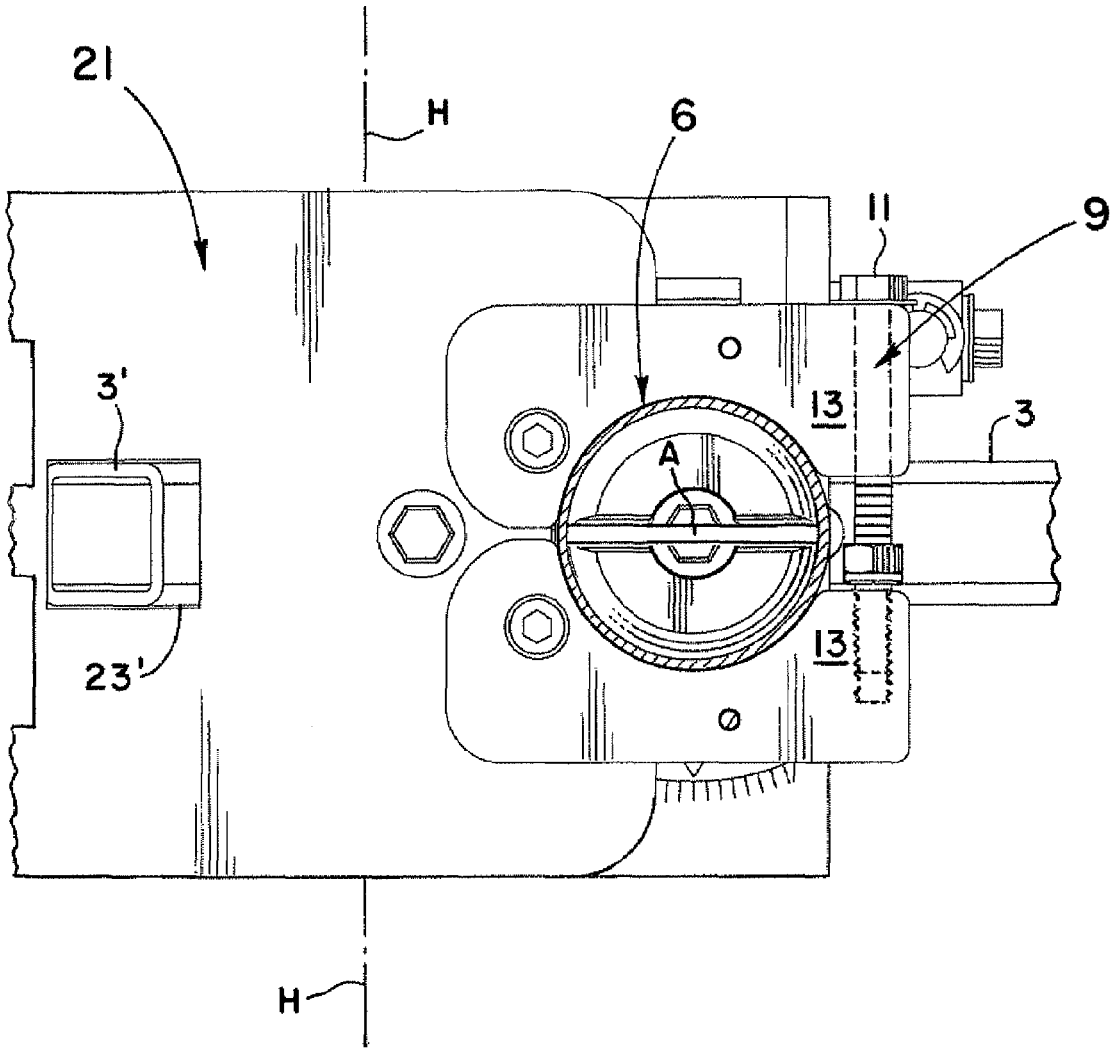
FIG. 4 is a view taken along line 4-4 of FIG. 3.

As shown in FIGS. 1 and 2, the tripod 1 of the present invention is designed to support the dish antenna assembly 2. The dish antenna assembly 2 in this regard includes the dish member 4 and the post member 6 extending downwardly therefrom. In use as illustrated, the post member 6 is supported on one leg 3 of the tripod 1. Additionally, and when not in use, the legs 3, 5, and 7 of the tripod mount 1 can be collapsed from their open position of FIGS. 1 and 2 to a closed position for storage or transport. This is accomplished via the steps illustrated in FIGS. 3-10 and described in more detail below. With these steps, the tripod 1 is moved from the open position of FIGS. 1 and 2 to the locked and compact, closed position of FIG. 11.

Figure 5:
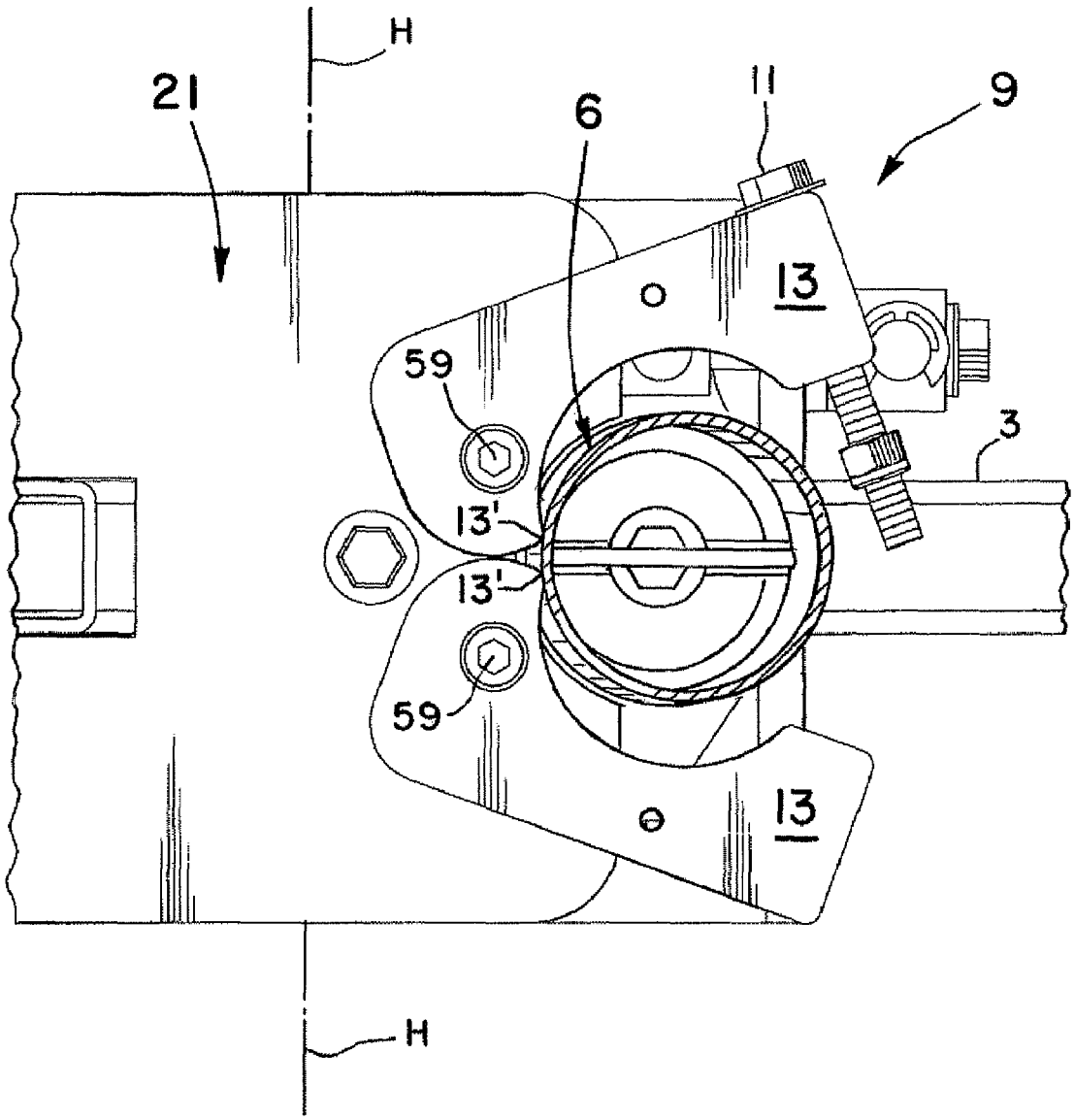
FIG. 5 is a view similar to FIG. 4 but with the arms of the clamping arrangement for the post member open.
Figure 6:
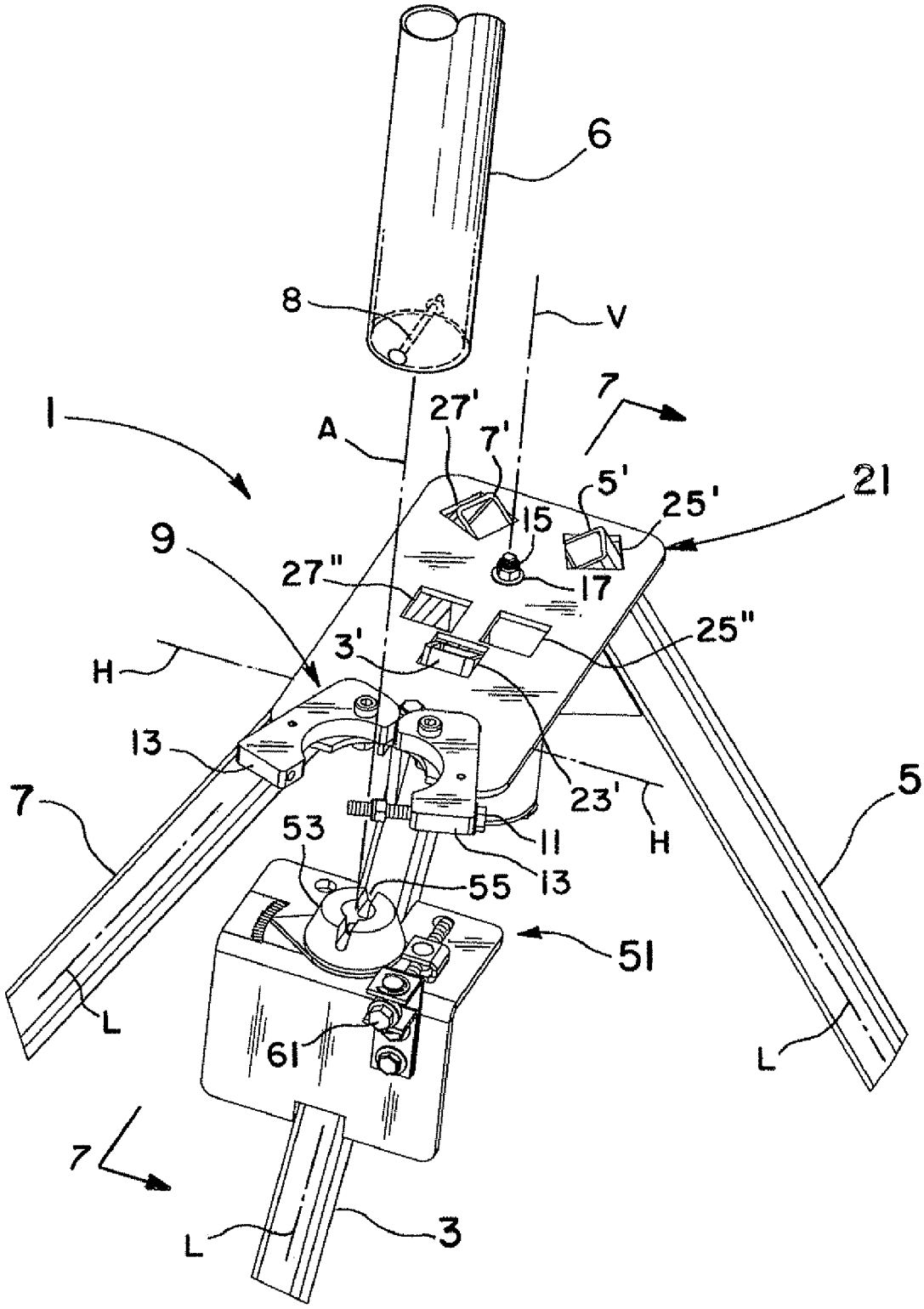
FIG. 6 is a perspective view of the tripod with its clamping arms open and the post member of the dish antenna assembly removed from it.

In collapsing the tripod 1 from its operating open position of FIGS. 1 and 2, the post member 6 of the dish antenna assembly 1 is first released from the clamping arrangement 9 of the tripod 1 (FIGS. 3-5) and removed from it (FIG. 6). To do this, the tightening bolt 11 (FIGS. 3 and 4) is first unscrewed or released. The clamp arms 13 can then be opened (FIG. 5) and the post member 6 removed (FIG. 6). Thereafter and with the central securing nut 15 and washer 17 for the locking plate member 21 of FIGS. 6 and 7 removed, the locking plate member 21 can be pivoted relative to the tripod leg 3 about the substantially horizontal axis H of FIG. 7. As shown, this pivoting motion about the axis H allows the locking plate member 21 to be moved or lifted from its lowered position (shown in solid lines in FIG. 7) to its raised position (shown in dotted lines in FIG. 7).

Figure 7:
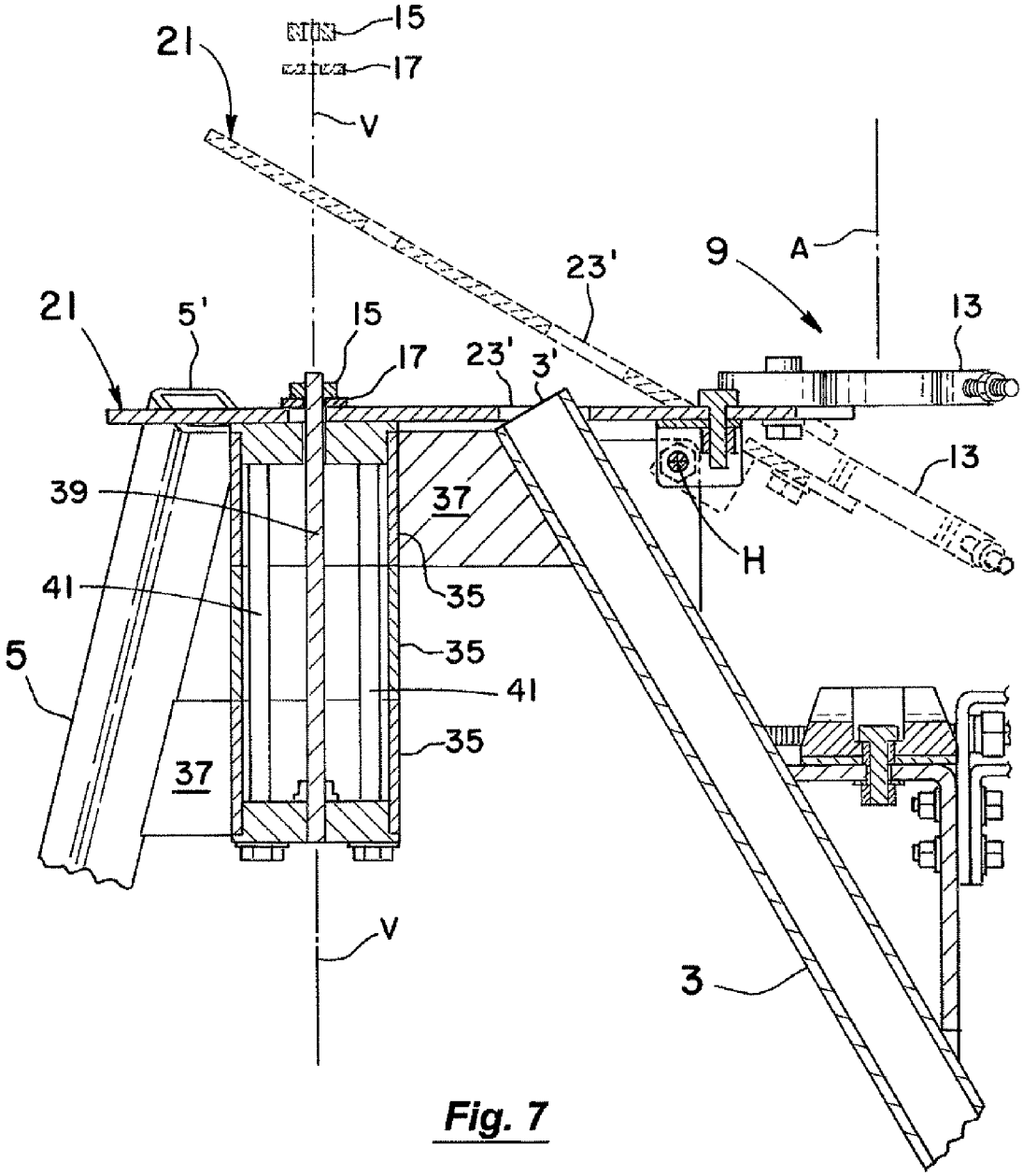
FIG. 7 is a view taken along line 7-7 of FIG. 6.
Figure 8:
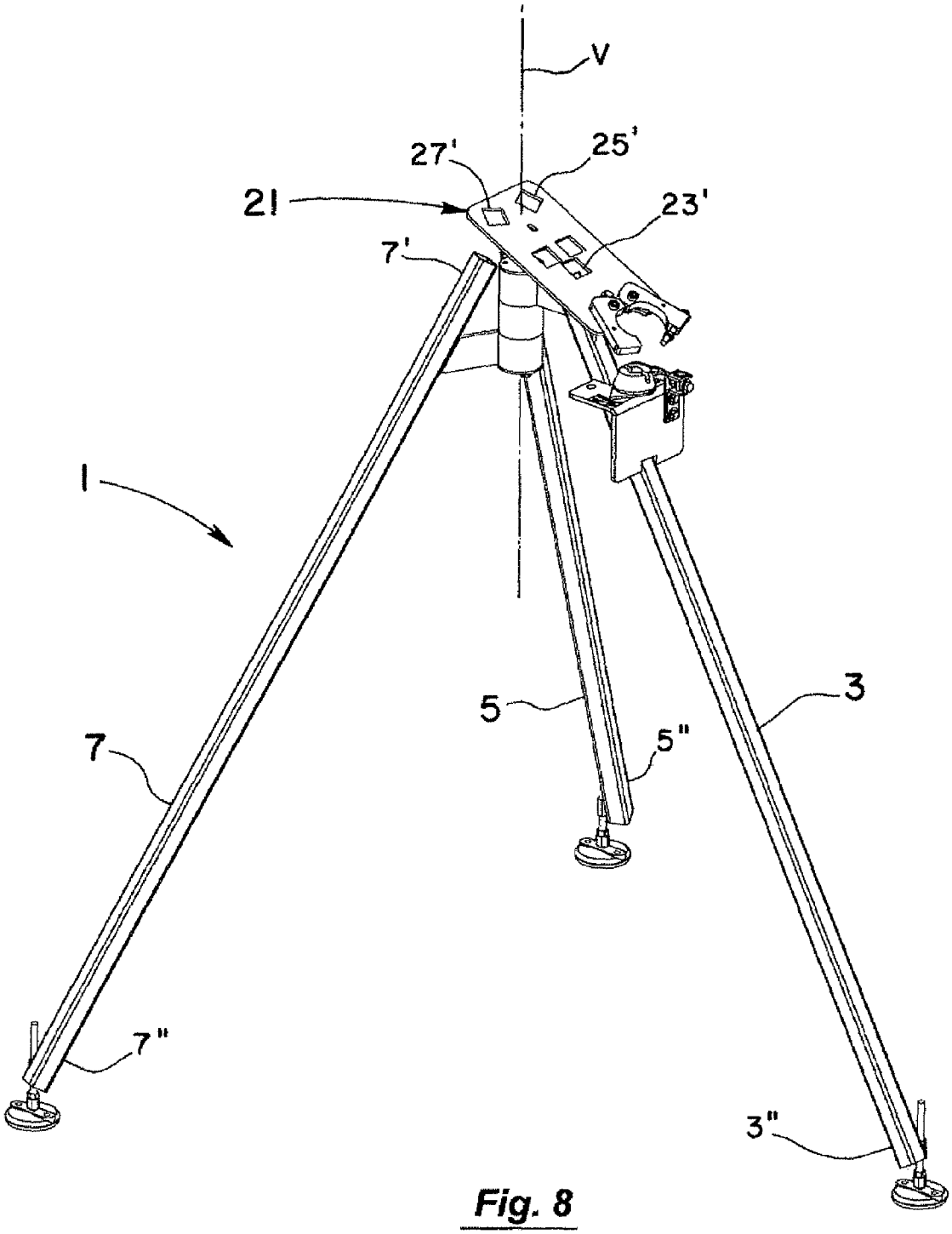
FIGS. 8-11 sequentially show how the legs of the tripod can be collapsed to the compact and closed position of FIG. 11.
Figure 9:
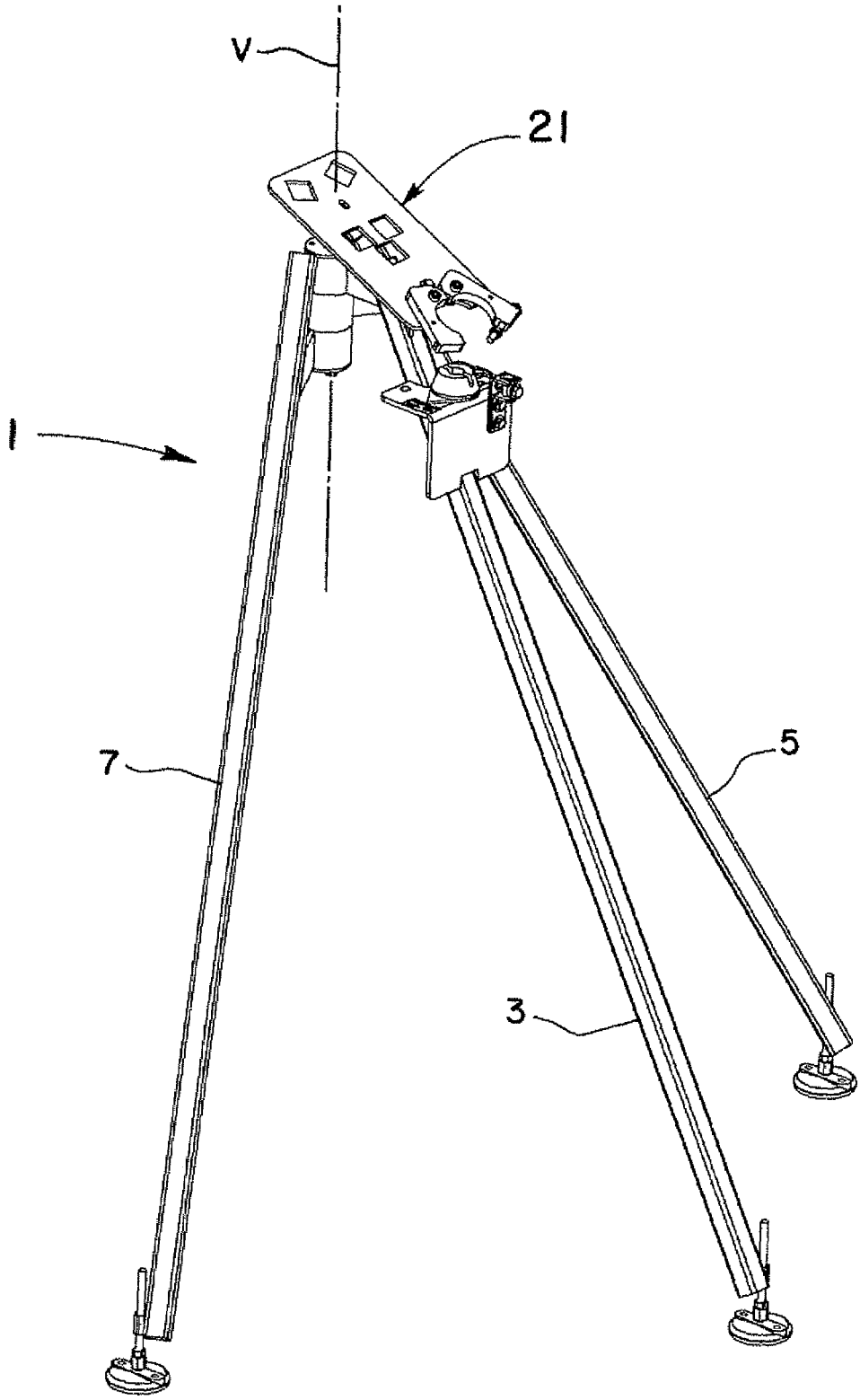

In moving the locking plate member 21 from its lowered, substantially horizontal position of FIGS. 6 and 7 to its raised or inclined position as shown in FIGS. 7 and 8, the first set of holes 23', 25', and 27' in the locking plate member 21 (FIG. 8) are moved upwardly. This upward movement lifts the first set of holes 23', 25', and 27' away from receiving the upper end portions 3', 5', and 7' of the tripod legs 3, 5, and 7 (compare FIGS. 6 and 8). The tripod legs 3, 5, and 7 with the locking plate 21 lifted as in FIG. 8 can then be rotated (FIG. 9) about the vertical axis V of the tripod 1 to the closed position of FIG. 10 and locked in place by again lowering the locking plate member 21 (FIG. 11). At this point, the upper end portions 3', 5', and 7' of the tripod legs 3, 5, and 7 are then received in the second set of holes 231, 25", and 27". With the nut 15 for the locking plate member 21 again tightened (FIG. 11), the collapsed tripod 1 is thus securely locked in place in its closed and compact position. In this closed position of FIG. 11, the elongated tripod legs 3, 5, and 7 are adjacent one another and their longitudinal axes L are substantially parallel to each other. The upper end portions 3', 5', and 7' and lower end portions 3", 5", and 71" of the legs 3, 5, and 7 are also closely grouped together.

Figure 11:
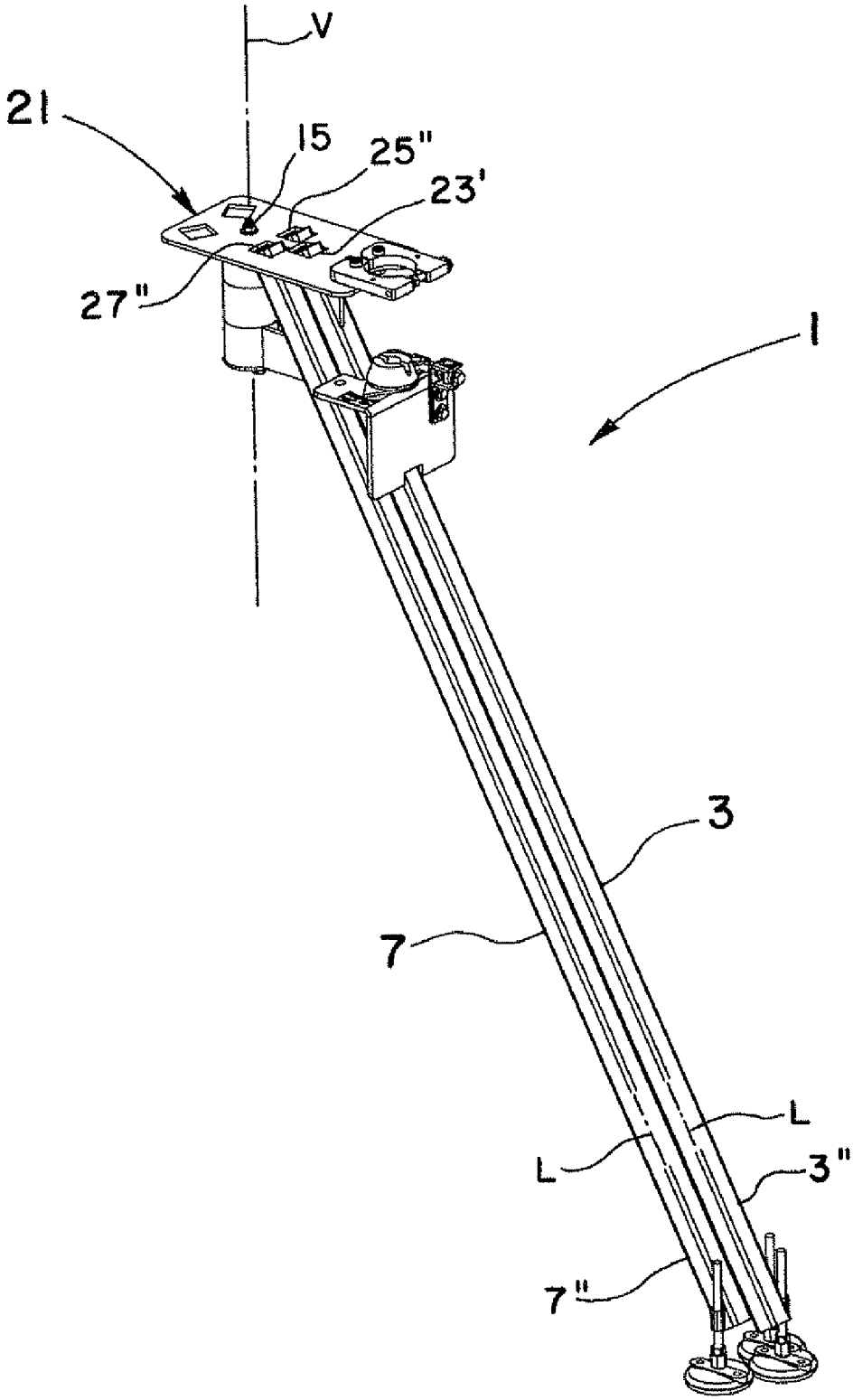
Figure 12A:
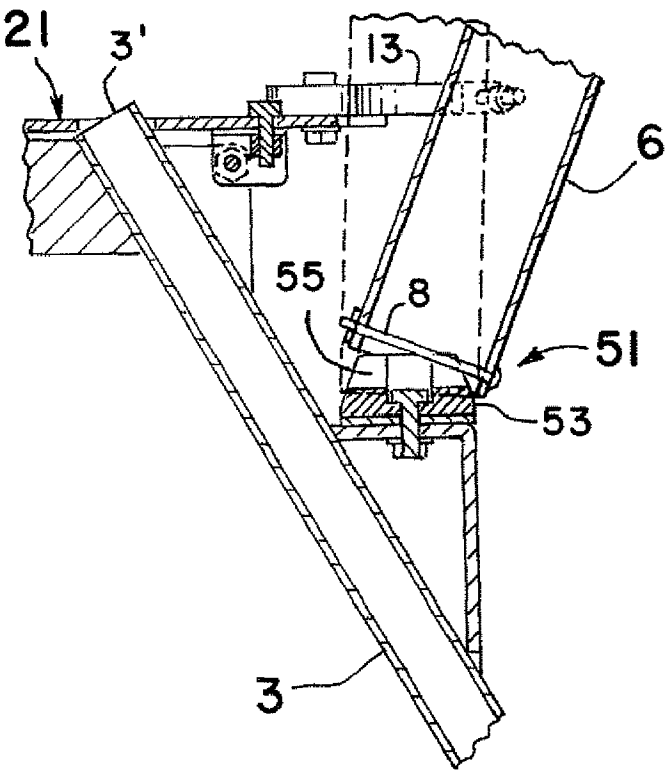
FIG. 12*a* is a view taken along line 12*a*-12*a* of FIG. 12.
Figure 12:
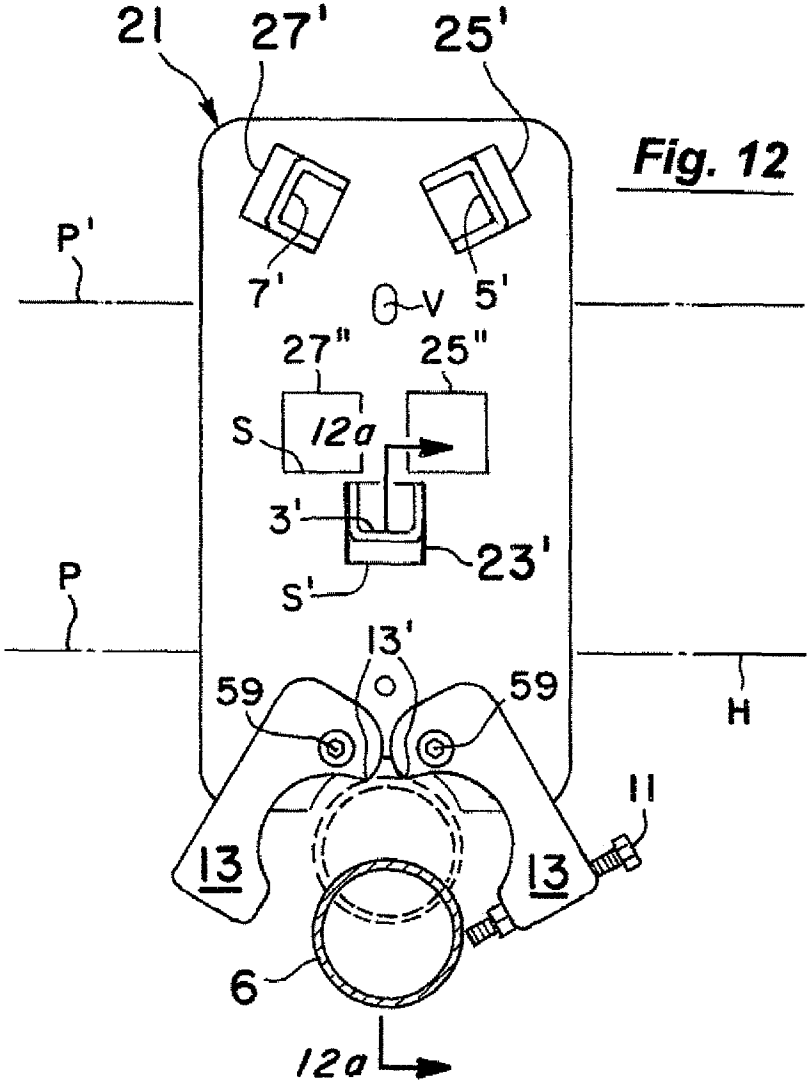
FIG. 12 is a top plan view of the locking plate member of the tripod with the post member of the dish antenna assembly shown being inserted into the clamping arrangement.

As discussed above, the locking plate member 21 selectively secures the tripod legs 3, 5, and 7 in their open position (FIGS. 1 and 2) and closed or collapsed position (FIG. 11). As also set forth above, this is accomplished by providing the first set (23', 25', and 27') and second set (23', 25", and 27") of holes in the locking plate member 21 (FIGS. 6 and 12). The first set of holes 23', 25', and 27' receives the upper end portions 3', 5', and 7' of the open tripod 1 when the locking plate member 21 is in its lowered position of FIGS. 6 and 12. In this lowered position as indicated above, the tripod legs 3, 5, and 7 are spaced from each other about the vertical axis V (FIGS. 1 and 2). Additionally, the longitudinal axes L of the legs 3, 5, and 7 are inclined to the vertical axis V as also illustrated in FIGS. 1 and 6. In the closed or collapsed position of the tripod 1 in FIG. 11, the upper end portions 3', 5', and 7' of the legs 3, 5, and 7 are then received in the second set of holes 23', 25", and 27", in the locking plate member 21. It is noted in this regard that the first and second sets of holes share the common hole 23'. In this manner and in both tripod positions, the lowered locking plate 21 prevents the legs 3, 5, and 7 from being rotated relative to each other about the vertical axis V.

The holes in the locking plate member 21 as best seen in FIG. 12 preferably have rectangular sides s. These sides s substantially match the sides s' of the rectangular cross section of each tripod leg 3, 5, and 7. In use, the upper end portions 3', 5', and 7' are at least partially received in the rectangular (e.g., square) holes with the corresponding straight sides s and s' of the holes and legs adjacent or abutting one another. In this manner, the tripod legs 3, 5, and 7 are securely held in place in both the open (FIG. 6) and closed (FIG. 11) positions.

As best seen in FIG. 12, the first and second sets of holes are on one side of a vertical plane P. This vertical plane P contains the horizontal pivotal axis H of the locking plate member 21. As also shown in FIG. 12, the holes 23', 25', and 27' of the first set are spaced about the vertical axis V from one another. As further illustrated, the holes 23', 25", and 27" of the second set are on an opposite side of a vertical plane P' (which contains the vertical axis V) from the holes 25' and 27' of the first set. It is also noted that the corresponding sides s of the rectangular holes 23', 25", and 27" of the second set are preferably parallel to one another as shown. In contrast, the corresponding sides s of the one hole 23' and hole 25' (or 27') of the first set are at angles to each other. These orientations aid in properly aligning and rigidly securing the tripod legs 3, 5 and 7 in their open and closed positions.

Figure 10:
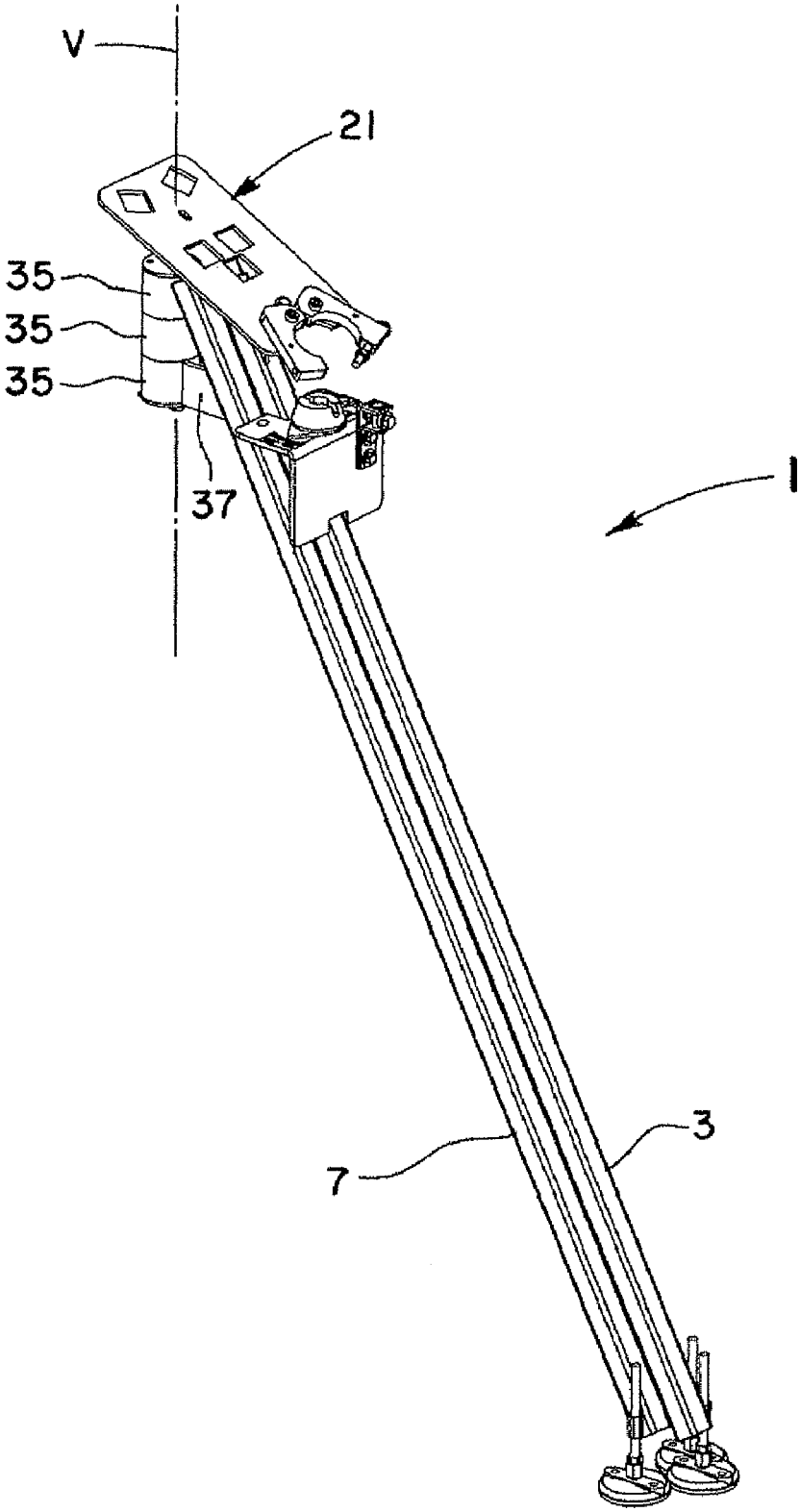

The upper end portions 3', 5', and 7' of each tripod leg 3, 5, and 7 as perhaps best seen in FIGS. 2, 7, and 10 include a substantially annular member 35 extending about the vertical axis V (FIG. 7). Each annual member 35 as shown is connected to the elongated portion of each leg 3, 5, and 7 by a flange 37 (FIG. 7). The annular members 35 are stacked atop one another as in FIG. 7 along the vertical axis V. In addition to the securing mechanism or nut 15 on the central bolt 39 in FIG. 7, an arrangement of one or more bolts 41 can also be provided. These bolts 41 can be selectively tightened as desired to draw the annular members 35 together to further resist rotation of the annular member 35 and legs 3, 5, and 7 about the vertical axis V.

Figure 13A:
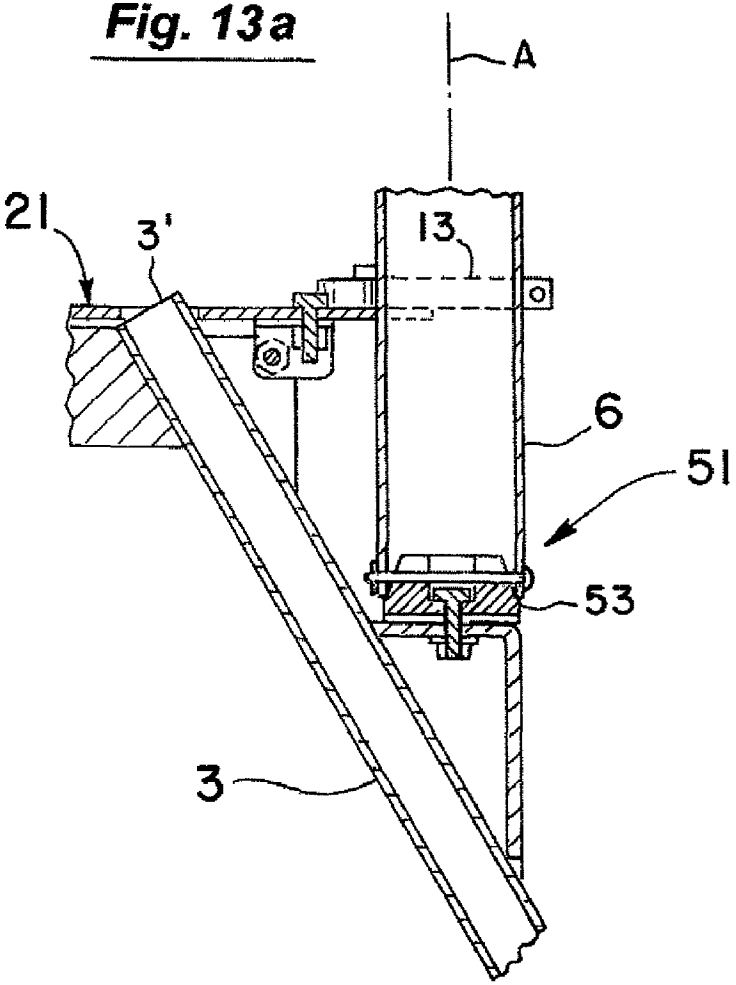
FIG. 13*a* is a view taken along line 13*a*-13*a* of FIG. 13.
Figure 13:
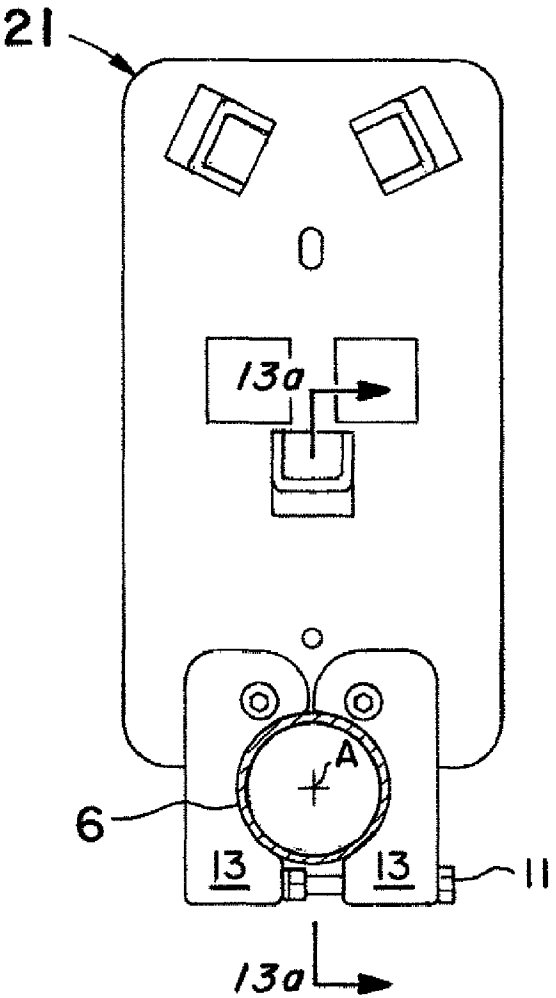
FIG. 13 is a top plane view of the locking plate member with the post member secured to it.
Figure 14:
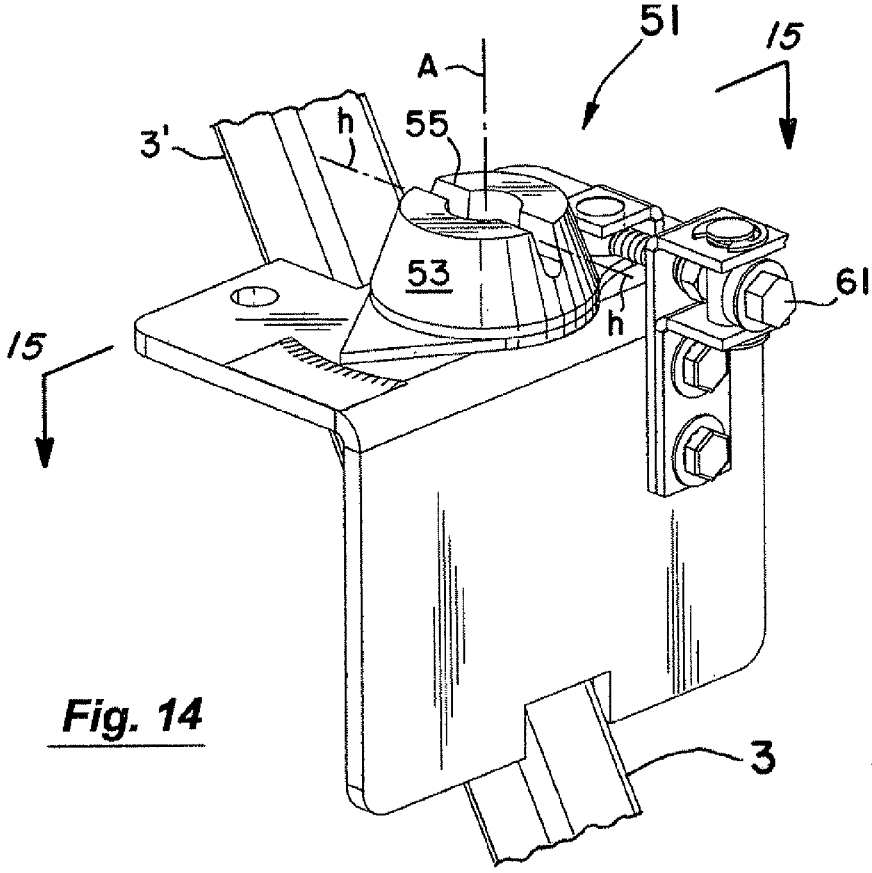
FIG. 14 is a perspective view of the adjustable azimuth arrangement mounted on one of the tripod legs.
Figure 15:
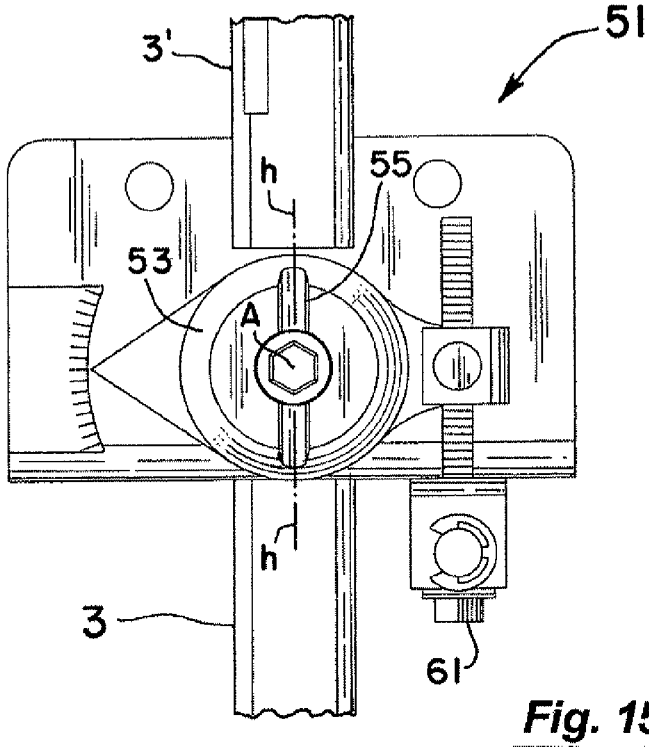
FIG. 15 is a view taken along line 15-15 of FIG. 14.

Another feature of the present invention is that the tripod 1 includes an adjustable azimuth arrangement 51 as perhaps best seen in FIGS. 2, 6, and 14-15. The adjustable azimuth arrangement 51 as shown is mounted on the tripod leg 3 adjacent the upper end portion 3' thereof (FIG. 14). The azimuth arrangement 51 includes the truncated, substantially conical member 53. As illustrated in FIGS. 14 and 15, the truncated conical member 53 has a substantially horizontal slot 55 extending along a horizontal axis h. The axis h and slot 55 in this regard extends substantially toward the tripod vertical axis V (see also FIG. 6). The downwardly extending post member 6 of the dish antenna assembly 2 in turn is provided with a pin 8 (FIG. 6). The pin 8 extends across the open end of the substantially cylindrical post member 6. In operation as illustrated in FIGS. 12 and **12*a*, the post member 6 (with the dish member 4 of the antenna assembly 2 attached thereto) can be first partially received or set in the slot 55 (FIG. 12*a*) In this position, most of the weight of the dish antenna assembly 2 is supported on the tripod 1 with the post member 6 inclined to the vertical. The clamp arms 13 of the locking plate member 21 are also open as shown in FIG. 12. The post member 6 can thereafter be easily moved or rocked to the vertical position of FIGS. 13 and 13*a* to align it on the truncated conical member 53** with the vertical azimuth axis A.

In doing so, the post member 6 (as shown in dotted lines in FIG. 12) will contact or abut the corners 13', of the clamp arms 13 (see also FIG. 5). This will cause the clamp arms 13 to automatically pivot about their axes 59 and close about the post member 6 as in FIG. 13. With the securing bolt 11 of the clamping arrangement 9 snugly (but not tightly) closing the clamp arms 13 about the post member 6, the turnbuckle at 61 of the adjustable azimuth arrangement 51 in FIGS. 6 and 14-15 can be manipulated. As perhaps best seen in FIG. 6, this will then serve to rotate the truncated conical member 53 and post member 6 supported thereon about the vertical azimuth axis A (see also FIG. 13*a*). Once the dish member 4 on the post member 6 is aligned as desired, the securing bolt 11 of the clamping arrangement 9 in FIG. 13 can be tightened in place. In aligning the dish member 4 for the strongest receiving and/or transmitting signal, the dish member 4 as illustrated in FIGS. 1 and 2 extends away from the post member 6 and the azimuth axis A toward the vertical axis V of the tripod 1. The bulk of the weight (e.g., 40 pounds) of the dish antenna assembly 2 is then positioned substantially centrally over the tripod 1 for a strong and stable mount.

The above disclosure sets forth a number of embodiments of the present invention described in detail with respect to the accompanying drawings. Those skilled in this art will appreciate that various changes, modifications, other structural arrangements, and other embodiments could be practiced under the teachings of the present invention without departing from the scope of this invention as set forth in the following claims.

I claim:

1. A collapsible tripod mount for a dish antenna assembly, said mount including:

at least three, elongated legs extending along respective axes between upper and lower end portions, said legs being attached to one another adjacent the respective upper end portions thereof for rotation relative to each other about a first substantially vertical axis between an open position with the axes of said legs inclined to said first vertical axis and said legs spaced from each other about said first vertical axis and a collapsed position with the axes of said legs substantially parallel to each other and said legs substantially adjacent one another, and a locking member for selectively securing said legs in said open and collapsed positions about said first vertical axis, said locking member including a first set of at least three holes to respectively receive the upper end portions of said legs therein with said legs in said open position and a second set of holes to respectively receive the upper end portions of said legs therein with said legs in said collapsed position, said legs with the upper end portions thereof in said respective first and second sets of holes in said locking member being prevented from being rotated relative to each other about said first vertical axis.

2. The mount of claim 1 wherein said first and second sets of holes have at least one hole in common.

3. The mount of claim 2 wherein said second set of holes has at least three holes.

4. The mount of claim 1 wherein said locking member is pivotally mounted to one of said legs adjacent the upper end portion thereof for movement about a substantially horizontal axis between a raised position and a lowered position, said locking member in said raised position spacing the first and second sets of holes away from receiving the upper end portions of said legs therein and said locking member in said lowered position selectively receiving the upper end portions of said legs in one of said first and second sets of holes.

5. The mount of claim 4 wherein said first and second sets of holes are on one side of a substantially vertical plane containing said horizontal axis.

6. The mount of claim 5 wherein said locking member is a substantially flat plate.

7. The mount of claim 6 further including a mechanism for selectively securing said plate in said lowered position receiving the upper end portions of said legs in one of said first and second sets of holes.

8. The mount of claim 1 wherein said upper end portions of said legs respectively include a substantially annular member extending about said first vertical axis, said annular members being stacked atop one another along said first vertical axis.

9. The mount of claim 8 further including at least one arrangement for selectively drawing said stacked annular members together to resist relative rotation of said annular members about said first vertical axis.

10. The mount of claim 1 wherein the holes of the first and second sets are spaced from one another about the first vertical axis.

11. The mount of claim 1 wherein the holes of the second set are on an opposite side of a vertical plane from at least two of the holes of the first set.

12. The mount of claim 1 wherein the upper end portions of said legs have respective cross sections with at least one substantially straight side and said holes of said first and second sets are respectively defined in part by at least one substantially straight side.

13. The mount of claim 12 wherein said upper end portions of said legs and said holes have substantially matching, rectangular cross sections.

14. The mount of claim 13 wherein the rectangular holes of the second set are defined by sides and corresponding sides of the holes are substantially parallel to each other.

15. The mount of claim 13 wherein the rectangular holes of the first set are defined by sides and corresponding sides of at least two of the holes are at angles to each other.

16. The mount of claim 1 wherein said dish antenna assembly includes a dish member and a member extending downwardly therefrom, said mount further including an adjustable azimuth arrangement mounted on one of said legs adjacent the upper end portion thereof, said downwardly extending member of said dish antenna assembly being supported on said azimuth arrangement, said azimuth arrangement with the downwardly extending member of said dish antenna assembly supported thereon being rotatable relative to said one leg about a second substantially vertical axis spaced from said first vertical axis to adjust the azimuth orientation of the dish member about the second vertical axis.

17. The mount of claim 16 wherein said adjustable azimuth arrangement includes a truncated substantially conical member, said downwardly extending member of said dish antenna assembly being substantially cylindrical with an open lower end portion, said open lower end portion receiving the truncated conical member of the azimuth arrangement therein.

18. The mount of claim 17 wherein said lower open end portion of said downwardly extending member has a substantially horizontal pin extending thereacross and said truncated conical member has a substantially horizontally extending slot therein to receive said pin.

19. The mount of claim 18 wherein said slot extends along an axis extending substantially toward said first vertical axis.

20. The mount of claim 16 wherein said locking member further includes a clamping arrangement to receive said downwardly extending member of said dish antenna assembly and selectively secure said downwardly extending member in said substantially vertical position supported on said azimuth arrangement with the legs of said mount in said open position.

21. The mount of claim 16 wherein the dish member of said dish antenna assembly is mounted to said downwardly extending member and extends away from said downwardly extending member toward said first vertical axis.

22. A tripod mount for a dish antenna assembly, said mount having at least three legs spaced from each other about a first substantially vertical axis, said dish antenna assembly having a dish member and a member extending downwardly therefrom, said mount further including an adjustable azimuth arrangement mounted on one of said legs in a position along said one leg spaced from the first vertical axis and spaced from the other legs about the first vertical axis, said downwardly extending member of said dish antenna assembly being supported on said azimuth arrangement on said one leg, said azimuth arrangement with said downwardly extending member of said dish antenna assembly supported thereon being rotatable relative to said one leg about a second substantially vertical axis spaced from said first vertical axis to adjust the azimuth orientation of the dish member about said second vertical axis.

23. The mount of claim 22 wherein the dish member of said dish antenna assembly is mounted to said downwardly extending member and extends away from said downwardly extending member toward said first vertical axis.

24. A tripod mount for a dish antenna assembly, said mount having at least three legs spaced from each other about a first substantially vertical axis, said dish antenna assembly having a dish member and a member extending downwardly therefrom, said mount further including an adjustable azimuth arrangement mounted on one of said legs, said downwardly extending member of said dish antenna assembly being supported on said azimuth arrangement, said azimuth arrangement with said downwardly extending member of said dish antenna assembly supported thereon being rotatable relative to said one leg about a second substantially vertical axis spaced from said first vertical axis to adjust the azimuth orientation of the dish member about said second vertical axis wherein said adjustable azimuth arrangement includes a truncated substantially conical member, said downwardly extending member of said dish antenna assembly being substantially cylindrical with an open lower end portion, said open lower end portion receiving the truncated conical member of the azimuth arrangement therein.

25. The mount of claim 24 wherein said lower open end portion of said downwardly extending member has a substantially horizontal pin extending thereacross and said truncated conical member has a substantially horizontally extending slot therein to receive said pin.

26. The mount of claim 25 wherein said slot extends along an axis extending substantially toward said first vertical axis.

27. A tripod mount for a dish antenna assembly, said mount having at least three legs spaced from each other about a first substantially vertical axis, said dish antenna assembly having a dish member and a member extending downwardly therefrom, said mount further including an adjustable azimuth arrangement mounted on one of said legs, said downwardly extending member of said dish antenna assembly being supported on said azimuth arrangement, said azimuth arrangement with said downwardly extending member of said dish antenna assembly supported thereon being rotatable relative to said one leg about a second substantially vertical axis spaced from said first vertical axis to adjust the azimuth orientation of the dish member about said second vertical axis and further including a locking member having a clamping arrangement to receive said downwardly extending member of said dish antenna assembly and selectively secure said downwardly extending member in said a substantially vertical position supported on said azimuth arrangement with the legs of said mount in an open position.

28. A method for adjusting the azimuth orientation of a dish antenna assembly mounted on a tripod, said dish antenna assembly having a dish member and a member extending downwardly therefrom, said tripod having at least three legs spaced from each other about a first substantially vertical axis and an adjustable azimuth arrangement mounted on one of said legs in a position along said one leg spaced from the first vertical axis and spaced from the other legs about the first vertical axis, said method including the steps of:

(a) placing said downwardly extending member of said dish antenna assembly on said azimuth arrangement on said one leg and (b) rotating said azimuth arrangement with the downwardly extending member of the dish antenna assembly supported thereon relative to said one leg about a second substantially vertical axis spaced from said first vertical axis to adjust the azimuth orientation of the dish member about the second vertical axis.

29. The method of claim 28 wherein the dish member of the dish antenna assembly is mounted to said downwardly extending member and extends away from said downwardly extending member and step (b) includes the further limitation of adjusting the azimuth orientation of the dish member about the second vertical axis to position the dish member away from the second vertical axis toward the first vertical axis.

30. A method for adjusting the azimuth orientation of a dish antenna assembly mounted on a tripod, said dish antenna assembly having a dish member and a member extending downwardly therefrom, said tripod having at least three legs spaced from each other about a first substantially vertical axis and an adjustable azimuth arrangement mounted on one of said legs, said method including the steps of:

(a) placing said downwardly extending member of said dish antenna assembly on said azimuth arrangement and (b) rotating said azimuth arrangement with the downwardly extending member of the dish antenna assembly supported thereon relative to said one leg about a second substantially vertical axis spaced from said first vertical axis to adjust the azimuth orientation of the dish member about the second vertical axis wherein the tripod has a clamping arrangement thereon and wherein step (a) includes the further limitation of placing said downwardly extending member of said dish antenna assembly on said azimuth arrangement at an angle to the second vertical axis of step (b) and moving said downwardly extending member toward said second vertical axis into said clamping arrangement prior to the rotating of step (b).

31. The method of claim 30 wherein the clamping arrangement includes at least two clamp arms pivotally mounted to a locking member and the moving of said downwardly extending member toward said second vertical axis abuts said downwardly extending member against said clamp arms to pivot said clamp arms to a substantially closed position about said downwardly extending member.

32. A method for adjusting the azimuth orientation of a dish antenna assembly mounted on a tripod, said dish antenna assembly having a dish member and a member extending downwardly therefrom, said tripod having at least three legs spaced from each other about a first substantially vertical axis and an adjustable azimuth arrangement mounted on one of said legs, said method including the steps of:

(a) placing said downwardly extending member of said dish antenna assembly on said azimuth arrangement and (b) rotating said azimuth arrangement with the downwardly extending member of the dish antenna assembly supported thereon relative to said one leg about a second substantially vertical axis spaced from said first vertical axis to adjust the azimuth orientation of the dish member about the second vertical axis wherein the azimuth arrangement has a truncated substantially conical member and said downwardly extending member of said dish antenna assembly is substantially cylindrical with an open lower end portion and step (a) includes the further limitation of placing the open lower end portion of the downwardly extending member over the truncated conical member.

33. The method of claim 32 wherein said open lower end portion has a pin extending substantially horizontally thereacross and said truncated conical member has a substantially horizontally extending slot and step (a) includes the further limitation of placing the open lower end portion of the downwardly extending member over the truncated conical member with the pin received in said slot.

* * * * *